US007290659B1

(12) United States Patent
Chou

(10) Patent No.: US 7,290,659 B1
(45) Date of Patent: Nov. 6, 2007

(54) PAD PACKAGE STRUCTURE FOR NAILER

(75) Inventor: Chien-Chi Chou, Chang-Hua Hsien (TW)

(73) Assignee: Yong Song Hardware & Tool Co., Ltd, Chang-Hua Hsien (TW)

( * ) Notice: Subject to any disclaimer, the term of this patent is extended or adjusted under 35 U.S.C. 154(b) by 623 days.

(21) Appl. No.: 10/833,715

(22) Filed: Apr. 27, 2004

(51) Int. Cl.
*B65D 85/00* (2006.01)

(52) U.S. Cl. ..... 206/445; 206/303; 206/493

(58) Field of Classification Search ..... 206/303, 206/394, 445, 493; 53/204, 409, 581
See application file for complete search history.

(56) References Cited

U.S. PATENT DOCUMENTS 2,882,170 A * 4/1959 Stewart ..... 426/110
3,280,987 A * 10/1966 Steinbock ..... 211/59.1
5,743,391 A * 4/1998 Hsiao ..... 206/303
5,927,494 A * 7/1999 Fowler et al. ..... 206/391
6,116,416 A * 9/2000 Hansen et al. ..... 206/308.3
6,138,824 A * 10/2000 Hyakusoku et al. ..... 206/307
6,338,410 B1 * 1/2002 Wasmund ..... 206/778

* cited by examiner

*Primary Examiner*—David T. Fidei
(74) *Attorney, Agent, or Firm*—Alan Kamrath; Kamrath & Associates PA

(57) ABSTRACT

A pad package structure for a nailer includes at least one package box having a top formed with a plurality of removable catch plates, a plurality of pads mounted in the package box, and a pull bar mounted on the package box and extended through each of the pads to move the pads. Thus, the package box has a plurality of removable catch plates, so that the pull bar and the pads can be removed from the package box directly by pushing and expanding the catch plates of the package box, thereby facilitating the user operating the pad package structure.

16 Claims, 9 Drawing Sheets

PAD PACKAGE STRUCTURE FOR NAILER

BACKGROUND OF THE INVENTION

1. Field of the Invention

The present invention relates to a pad package structure for a nailer, and more particularly to a pad package structure, wherein the package box has a plurality of removable catch plates, so that the pull bar and the pads can be removed from the package box directly by pushing and expanding the catch plates, thereby facilitating the user operating the pad package structure.

2. Description of the Related Art

A conventional pad package structure for a nailer comprises a package box, a plurality of pads mounted in the package box, and a cover mounted on a top of the package box to cover the pads. In use, the cover is removed from the package box, so that the pads can be removed outward from the package box for use by the nailer. However, a user needs to remove the cover from the package box and then to remove the pads from the package box for use, thereby causing inconvenience to the use when needing to use the pads.

SUMMARY OF THE INVENTION

The primary objective of the present invention is to provide a pad package structure for a nailer, wherein the package box has a plurality of removable catch plates, so that the pull bar and the pads can be removed from the package box directly by pushing and expanding the catch plates of the package box, thereby facilitating the user operating the pad package structure.

Another objective of the present invention is to provide a pad package structure for a nailer, wherein the package box is integrally formed with the removable catch plates without having to additionally provide a cover, thereby simplifying the construction of the pad package structure, and thereby decreasing costs of fabrication and package.

A further objective of the present invention is to provide a pad package structure for a nailer, wherein the pads can be removed from the package box easily and conveniently, thereby facilitating the user taking the pads for use.

In accordance with the present invention, there is provided a pad package structure, comprising:

at least one package box having a top formed with a plurality of removable catch plates;

a plurality of pads mounted in the package box; and a pull bar mounted on the package box and extended through each of the pads to move the pads.

Further benefits and advantages of the present invention will become apparent after a careful reading of the detailed description with appropriate reference to the accompanying drawings.

DETAILED DESCRIPTION OF THE INVENTION

Figure 1:
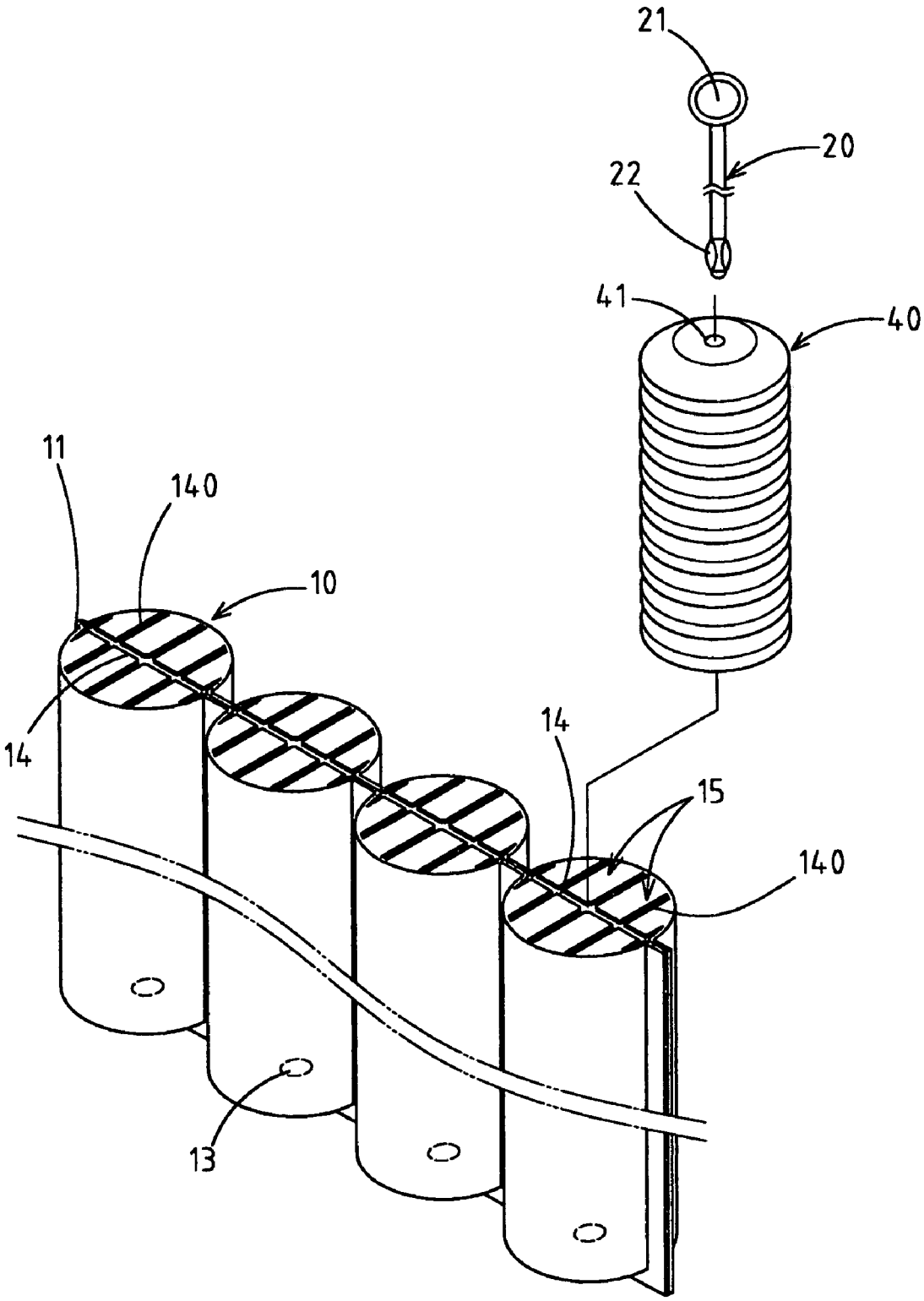
FIG. 1 is a partially exploded perspective view of a pad package structure for a nailer in accordance with the preferred embodiment of the present invention.

Referring to the drawings and initially to FIGS. 1-5, a pad package structure for a nailer in accordance with the preferred embodiment of the present invention comprises a plurality of package boxes 10, a plurality of pads 40 mounted in each of the package boxes 10, and a pull bar 20 mounted on each of the package boxes 10 and extended through each of the pads 40 to move the pads 40.

The package boxes 10 are connected with each other in a serial manner by a plurality of connecting portions 11. Each of the package boxes 10 is substantially cylindrical. Each of the package boxes 10 has an inside formed with a receiving space 12 and has a top formed with a plurality of removable catch plates 15 and a bottom formed with a through hole 13 communicating with the receiving space 12. The top of each of the package boxes 10 has a central portion formed with a central cutout 14 radially extended through the top of each of the package boxes 10. The top of each of the package boxes 10 is formed with a plurality of transverse slits 140 each intersecting the cutout 14, and the catch plates 15 are defined by the cutout 14 and the slits 140. Preferably, each of the slits 140 is perpendicular to the cutout 14.

The pads 40 are laminated with each other in a perpendicular manner. The pads 40 are mounted in the receiving space 12 of the package box 10 and stopped by the catch plates 15 of the package box 10. Each of the pads 40 has a center formed with a through hole 41 aligning with the cutout 14 of the package box 10. Preferably, the through hole 41 of each of the pads 40 has a size smaller than that of the through hole 13 of the package box 10.

The pull bar 20 is a substantially cylindrical bar. The pull bar 20 is extended through the cutout 14 of the package box 10 and the through hole 41 of each of the pads 40 and has a first end formed with an enlarged stop portion 22 rested on a lowermost pad 40 and protruded outward from the through hole 13 of the package box 10. Preferably, the stop portion 22 of the pull bar 20 is flexible and has an arcuate shape. Preferably, the stop portion 22 of the pull bar 20 has a size smaller than that of the through hole 13 of the package box 10 and greater than that of the through hole 41 of each of the pads 40. The pull bar 20 has a second end formed with a handle 21 to facilitate a user gripping the pull bar 20.

Figure 2:
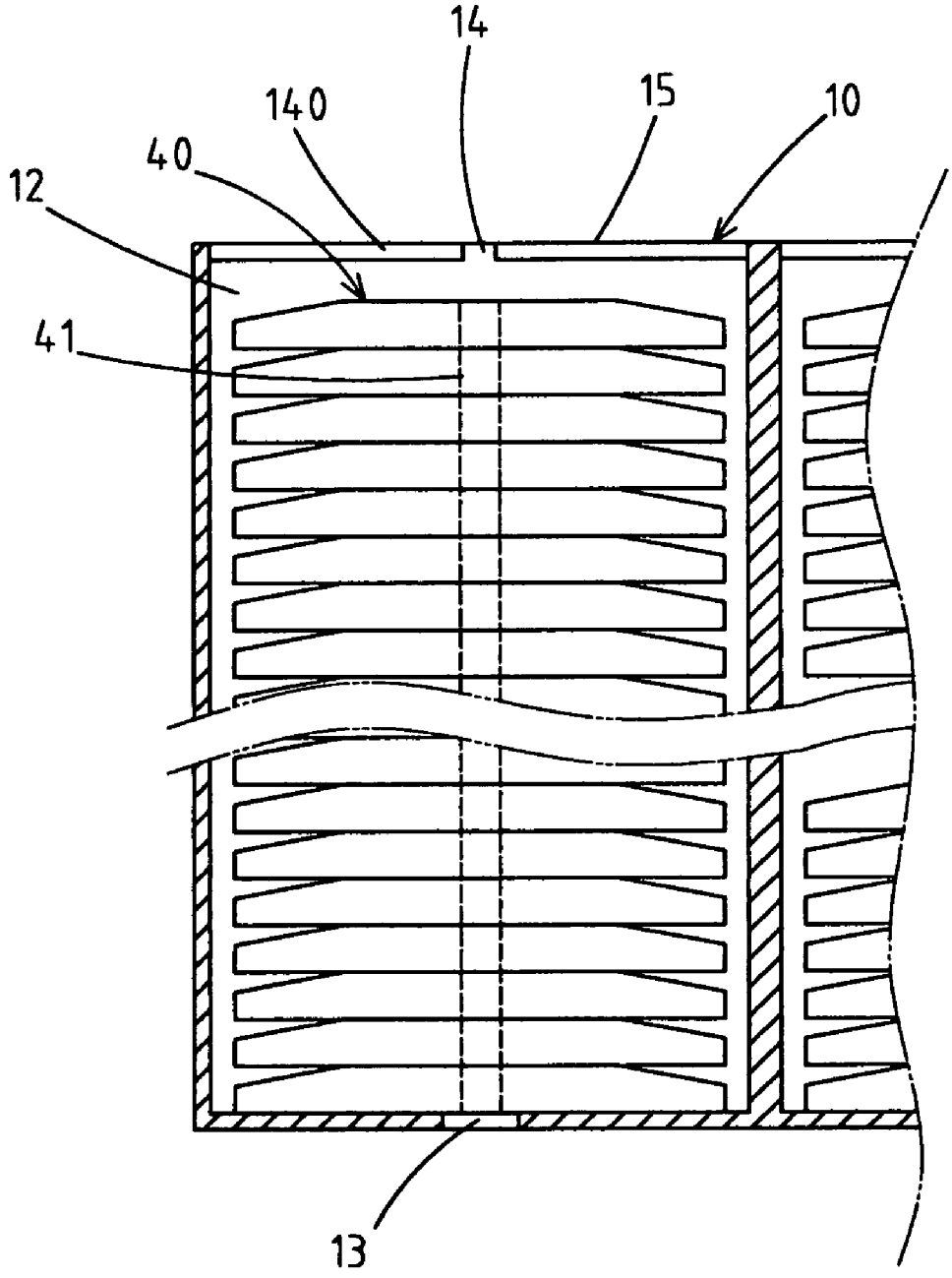
FIG. 2 is a partially plan cross-sectional assembly view of the pad package structure as shown in FIG. 1.

As shown in FIG. 2, the pads 40 laminated in a perpendicular manner are mounted in the receiving space 12 of the package box 10 and stopped by the catch plates 15 of the package box 10. At this time, the through hole 41 of each of the pads 40 is aligning with the cutout 14 of the package box 10.

Figure 3:
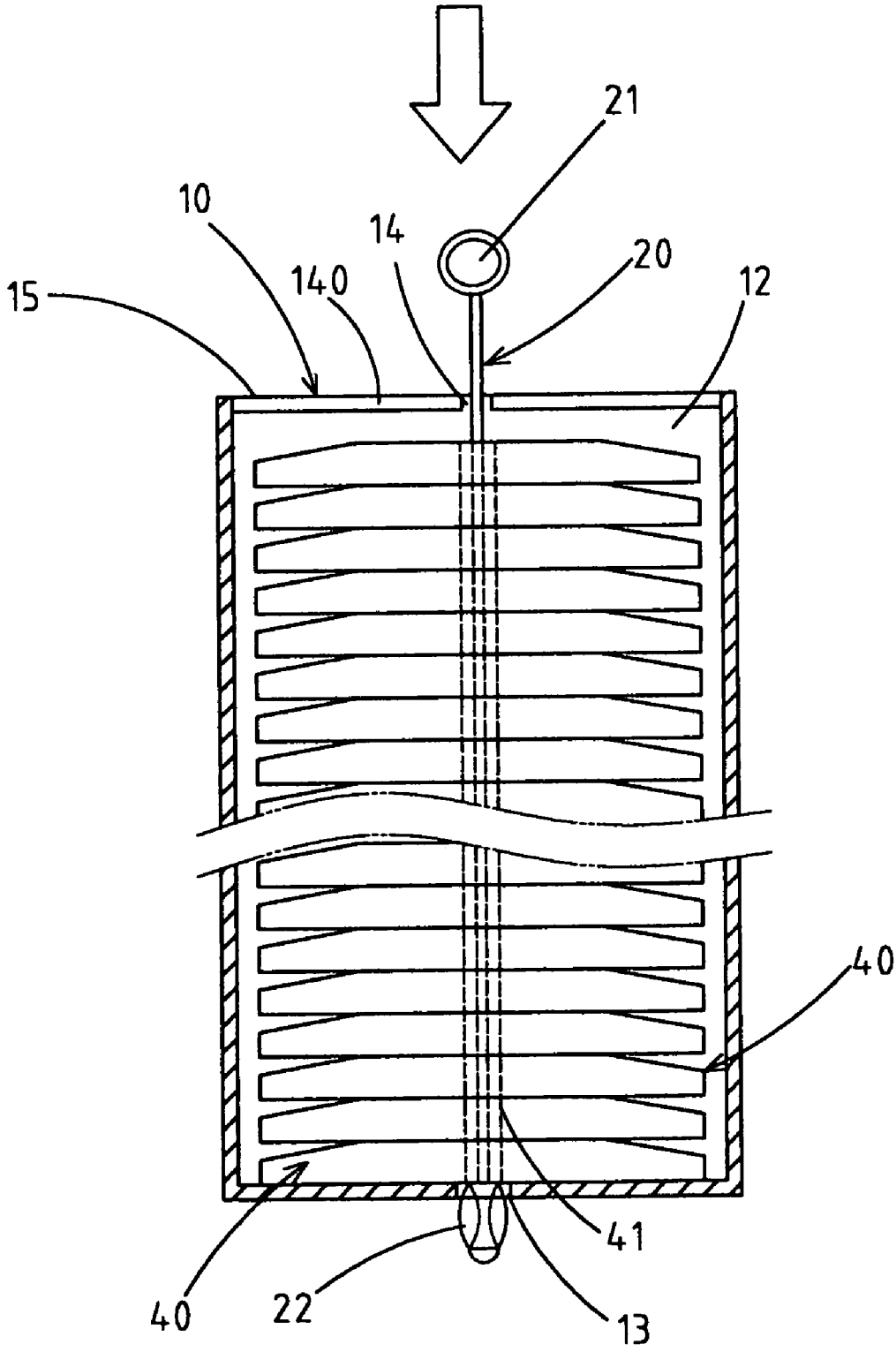
FIG. 3 is a partially plan cross-sectional assembly view of the pad package structure as shown in FIG. 1.

As shown in FIG. 3, the pull bar 20 is extended through the cutout 14 of the package box 10 and the through hole 41 of each of the pads 40. At this time, the user has to exert a force on the pull bar 20 to force the stop portion 22 of the pull bar 20 to pass through the through hole 41 of each of the pads 40. After the stop portion 22 of the pull bar 20 is passed through the through hole 41 of each of the pads 40, the stop portion 22 of the pull bar 20 is rested on the lowermost pad 40 and protruded outward from the through hole 13 of the package box 10. In such a manner, each of the pads 40 is fixed on the pull bar 20 by the stop portion 22 of the pull bar 20, so that the pads 40 are moved by movement of the pull bar 20.

Figure 4:
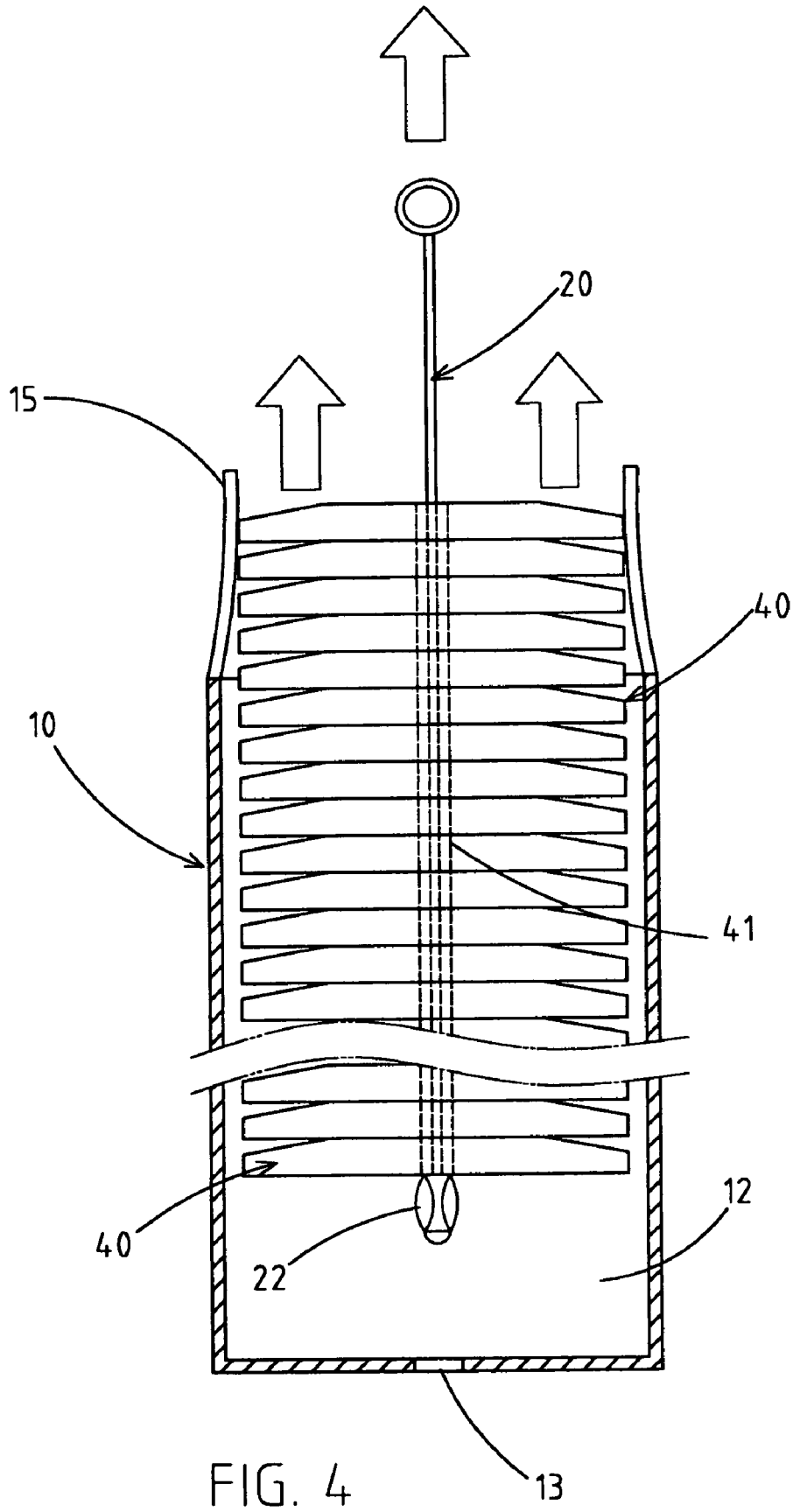
FIG. 4 is a schematic operational view of the pad package structure as shown in FIG. 3.

As shown in FIG. 4, the pull bar 20 is pulled outward from the package box 10 to push and expand the catch plates 15 of the package box 10 outward so as to remove the pads 40 from the package box 10.

Figure 5:
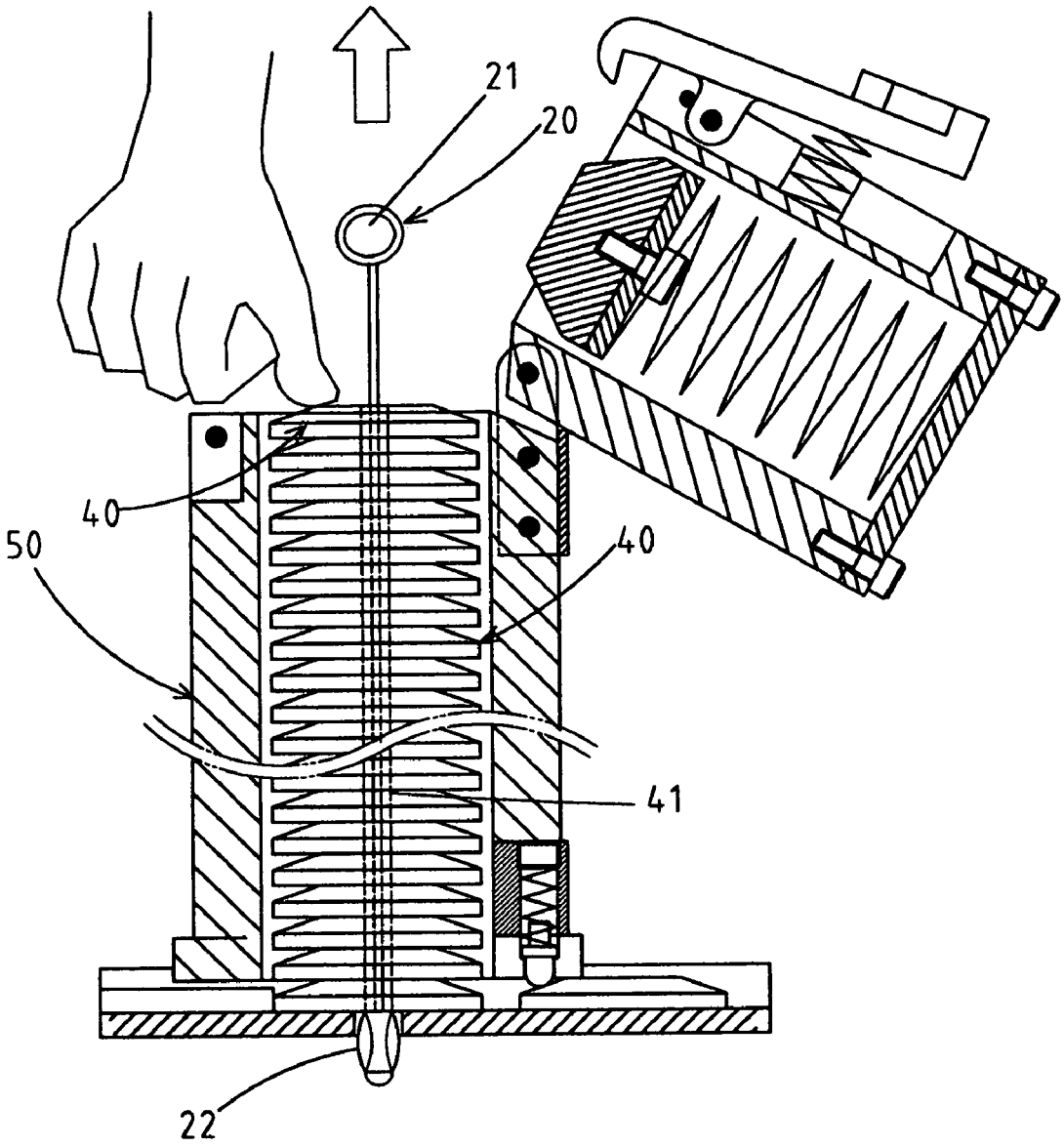
FIG. 5 is a schematic operational view of the pad package structure as shown in FIG. 4.
Figure 6:
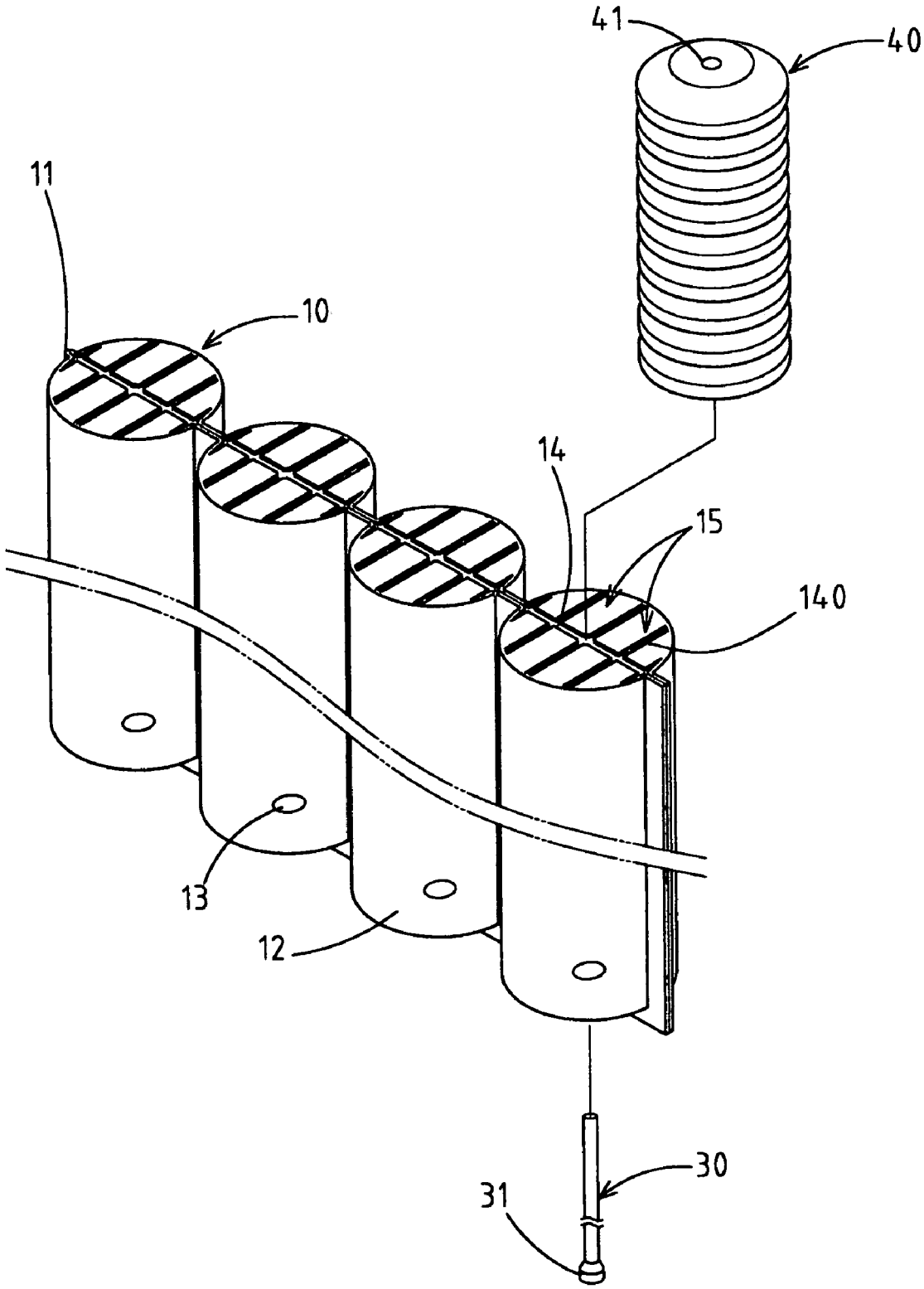
FIG. 6 is a partially exploded perspective view of a pad package structure for a nailer in accordance with another embodiment of the present invention.

As shown in FIG. 5, after the pads 40 are placed in a mounting seat 50 of a nailer, the user exerts a force to press the uppermost pad 40 and exerts a force on the handle 21 of the pull bar 20 to pull and detach the pull bar 20 from the pads 40, thereby leaving the pads 40 in the mounting seat 50 of the nailer for use.

Referring to FIGS. 6-9, the pad package structure for a nailer in accordance with another embodiment of the present invention comprises a pull bar 30 mounted on the package box 10 and extended through each of the pads 40 to move the pads 40. The pull bar 30 is a substantially cylindrical bar. The pull bar 30 is extended through the through hole 13 of the package box 10, the through hole 41 of each of the pads 40 and the cutout 14 of the package box 10 and is protruded outward from the cutout 14 of the package box 10. The pull bar 30 has a distal end formed with an enlarged locking portion 31 rested on a lowermost pad 40 and protruded outward from the through hole 13 of the package box 10. Preferably, the locking portion 31 of the pull bar 30 has a tapered shape. Preferably, the locking portion 31 of the pull bar 30 has a size smaller than that of the through hole 13 of the package box 10 and greater than that of the through hole 41 of each of the pads 40.

Figure 7:
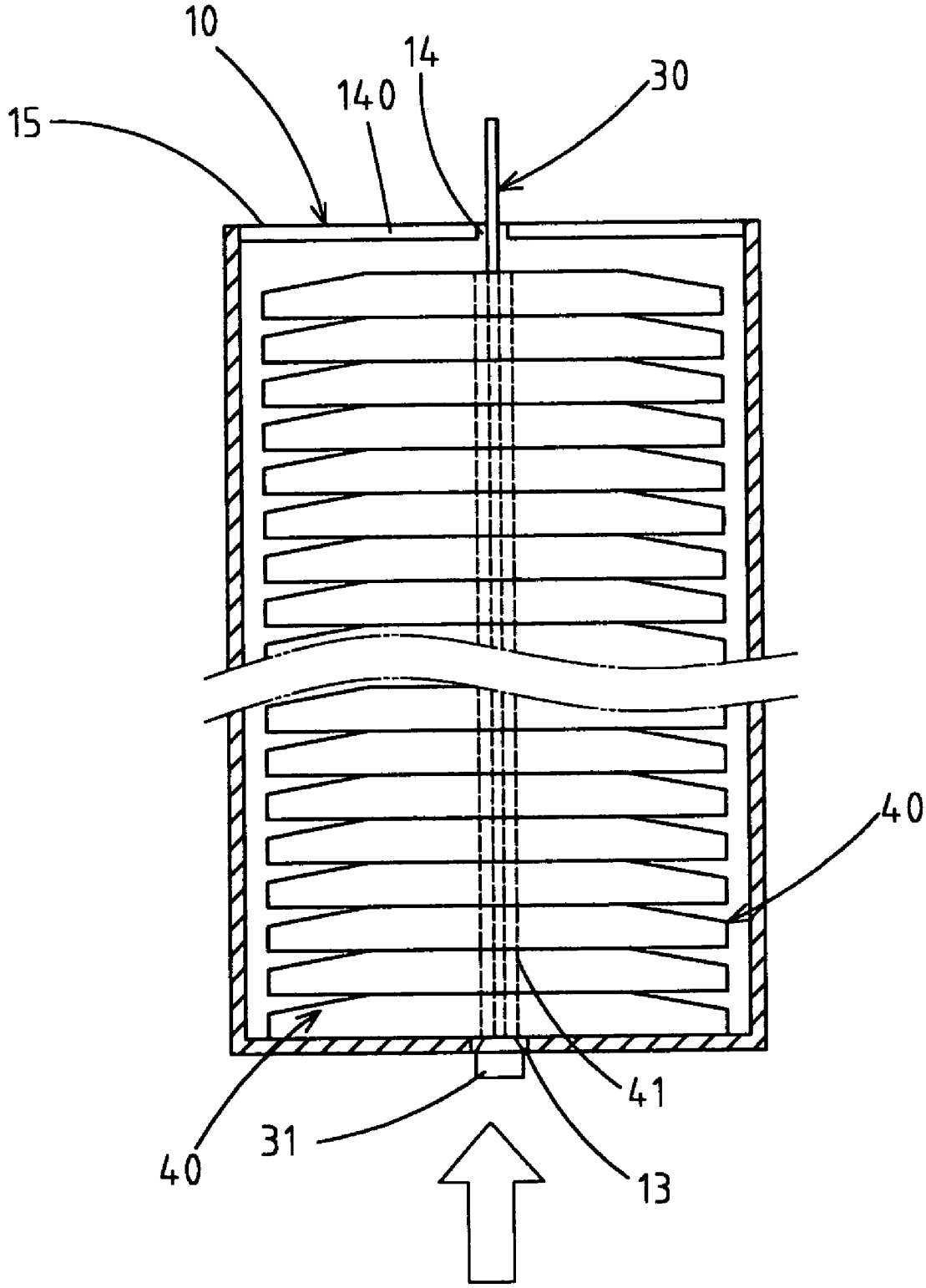
FIG. 7 is a partially plan cross-sectional assembly view of the pad package structure as shown in FIG. 6.

As shown in FIG. 7, the pull bar 30 is extended through the through hole 13 of the package box 10, the through hole 41 of each of the pads 40 and the cutout 14 of the package box 10 and is protruded outward from the cutout 14 of the package box 10. At this time, the locking portion 31 of the pull bar 30 is rested on the lowermost pad 40 and protruded outward from the through hole 13 of the package box 10. In such a manner, each of the pads 40 is fixed on the pull bar 30 by the locking portion 31 of the pull bar 30, so that the pads 40 are moved by movement of the pull bar 30.

Figure 8:
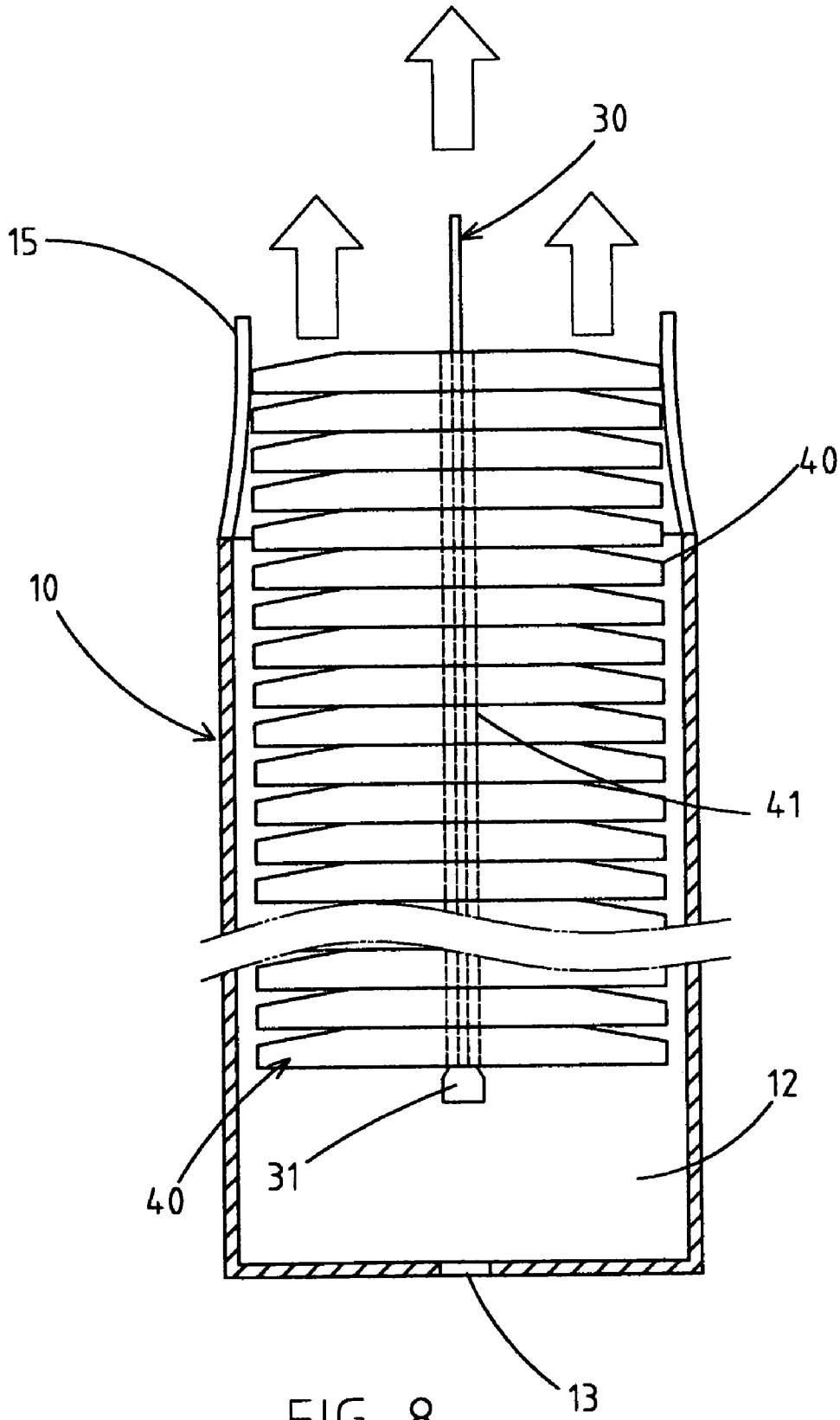
FIG. 8 is a schematic operational view of the pad package structure as shown in FIG. 7.

As shown in FIG. 8, the pull bar 30 is pulled outward from the package box 10 to push and expand the catch plates 15 of the package box 10 outward so as to remove the pads 40 from the package box 10.

Figure 9:
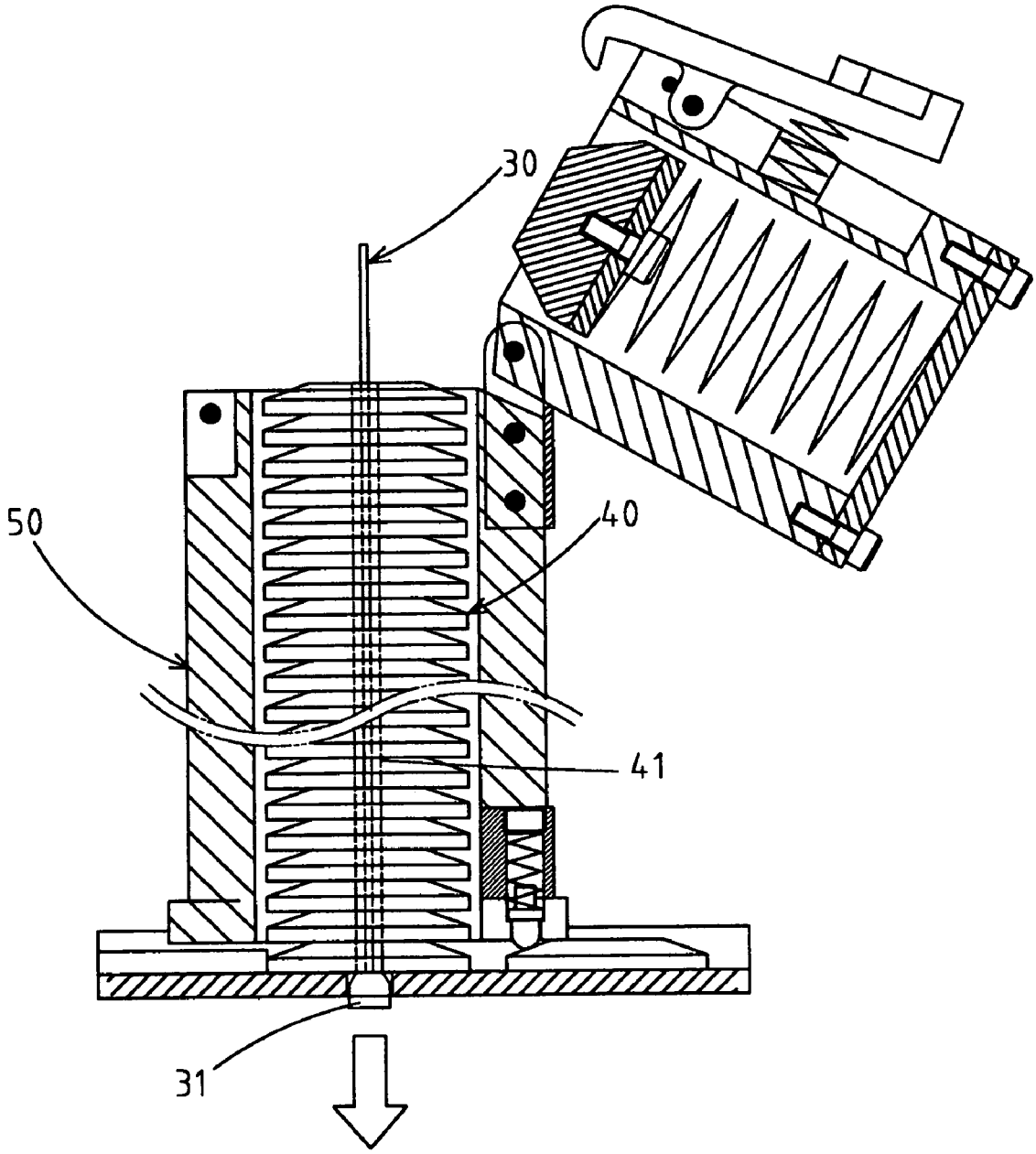
FIG. 9 is a schematic operational view of the pad package structure as shown in FIG. 8.

As shown in FIG. 9, after the pads 40 are placed in a mounting seat 50 of a nailer, the user exerts a force on the locking portion 31 of the pull bar 30 to pull the locking portion 31 of the pull bar 30 outward from the mounting seat 50 so as to pull and detach the pull bar 30 from the pads 40, thereby leaving the pads 40 in the mounting seat 50 of the nailer for use.

Accordingly, the package box has a plurality of removable catch plates, so that the pull bar and the pads can be removed from the package box directly by pushing and expanding the catch plates of the package box, thereby facilitating the user operating the pad package structure. In addition, the package box is integrally formed with the removable catch plates without having to additionally provide a cover, thereby simplifying the construction of the pad package structure, and thereby decreasing costs of fabrication and package. Further, the pads can be removed from the package box easily and conveniently, thereby facilitating the user taking the pads for use.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A pad package structure, comprising:

at least one package box having a top formed with a plurality of removable catch plates;

a plurality of pads mounted in the package box; and a pull bar mounted on the package box and extended through each of the pads to move the pads;

wherein the top of each of the package boxes has a central portion formed with a central cutout extended through the top of each of the package boxes, the top of each of the package boxes is formed with a plurality of transverse slits each intersecting the cutout, and the catch plates are defined by the cutout and the slits.

2. The pad package structure in accordance with claim 1, wherein each of the slits is perpendicular to the cutout.

3. The pad package structure in accordance with claim 1, wherein the package box is substantially cylindrical.

4. The pad package structure in accordance with claim 1, wherein the package box has an inside formed with a receiving space, and the pads are mounted in the receiving space of the package box and stopped by the catch plates of the package box.

5. The pad package structure in accordance with claim 1, wherein each of the pads has a center formed with a through hole aligning with the cutout of the package box.

6. The pad package structure in accordance with claim 5, wherein the package box has a bottom formed with a through hole, and the through hole of each of the pads has a size smaller than that of the through hole of the package box.

7. The pad package structure in accordance with claim 6, wherein the pull bar is extended through the cutout of the package box and the through hole of each of the pads and has a first end formed with an enlarged stop portion rested on a lowermost pad and protruded outward from the through hole of the package box.

8. The pad package structure in accordance with claim 7, wherein the stop portion of the pull bar has a size smaller than that of the through hole of the package box and greater than that of the through hole of each of the pads.

9. The pad package structure in accordance with claim 7, wherein the stop portion of the pull bar is flexible and has an arcuate shape.

10. The pad package structure in accordance with claim 7, wherein the pull bar has a second end formed with a handle to facilitate a user gripping the pull bar.

11. The pad package structure in accordance with claim 1, wherein the bar is a substantially cylindrical bar.

12. The pad package structure in accordance with claim 6, wherein the pull bar is extended through the through hole of the package box, the through hole of each of the pads and the cutout of the package box and is protruded outward from the cutout of the package box.

13. The pad package structure in accordance with claim 12, wherein the pull bar has a distal end formed with an enlarged locking portion rested on a lowermost pad and protruded outward from the through hole of the package box.

14. The pad package structure in accordance with claim 13, wherein the locking portion of the pull bar has a tapered shape.

15. The pad package structure in accordance with claim 13, wherein the locking portion of the pull bar has a size smaller than that of the through hole of the package box and greater than that of the through hole of each of the pads.

16. The pad package structure in accordance with claim 1, wherein the pad package structure comprises a plurality of package boxes connected with each other by a plurality of connecting portions.

* * * * *